US005386145A

United States Patent [19]

Boswell

[11] Patent Number: 5,386,145

[45] Date of Patent: Jan. 31, 1995

[54] FUEL DELIVERY MEANS FOR CARBURETORS FOR INTERNAL COMBUSTION ENGINES AND METHOD FOR INSTALLING SAME

[76] Inventor: George A. Boswell, 23 N. 9th St., East Alton, Ill. 62095

[21] Appl. No.: 62,054

[22] Filed: May 14, 1993

[51] Int. Cl.[6] ..... F02M 19/03

[52] U.S. Cl. ..... 261/41.1; 261/78.1; 261/DIG. 39; 261/DIG. 68; 261/71

[58] Field of Search ..... 261/78.1, DIG. 39, 41.1, 261/DIG. 68, 71, 41.5

[56] References Cited

U.S. PATENT DOCUMENTS

| | | | |
|---|---|---|---|
| 2,229,819 | 1/1941 | Reid | 261/DIG. 39 |
| 2,957,683 | 10/1960 | Eberhardt | 261/41.1 |
| 3,030,084 | 4/1962 | Phillips | 261/41.1 |
| 3,066,922 | 12/1962 | Wucherer | 261/41.1 |
| 4,000,224 | 12/1976 | Phelps | 261/41.5 |
| 4,065,526 | 12/1977 | Englert et al. | 261/DIG. 39 |
| 4,075,296 | 2/1978 | Orsini et al. | 261/41.5 |
| 4,375,438 | 3/1983 | McKay | 261/DIG. 39 |
| 4,447,370 | 5/1984 | Kobayashi et al. | 261/35 |
| 4,578,228 | 3/1986 | Gerhardy | 261/41 |
| 4,861,522 | 8/1989 | Gerhardy et al. | 261/35 |
| 4,877,560 | 10/1989 | Kenny et al. | 261/35 |
| 4,903,655 | 2/1990 | Vonderau et al. | 123/198 |
| 5,133,905 | 7/1992 | Woody et al. | 261/35 |

OTHER PUBLICATIONS

A Simple Switch; Charles Plueddeman, Water Scooter, Oct. 1992; 42–45.

Jet Setting:Part 1; Jimmie O'Dell; Water Scooter, Oct. 1992; 46–53 and 83–84.

Jet Setting:Part 11; Jimmie O'Dell; Water Scooter, Dec. 1992; 36–39.

Nuts & Bolts; Bruce Fordyce; Splash; 50–51 Jan. 1993.

*Primary Examiner*—Tim Miles

*Attorney, Agent, or Firm*—Haverstock, Garrett & Roberts

[57] ABSTRACT

In a carburetor for an internal combustion engine, the improvement embodying an air flow surface disposed strategically in a venturi or air flow passageway of the carburetor, the air flow surface providing enhanced air flow velocity characteristics over a region thereof relative to the free stream velocity over the air flow surface, and an orifice located adjacent to the air flow surface in the vicinity of the region of enhanced air flow velocity so as to provide a vacuum signal through the orifice which corresponds substantially proportionally to the air flow velocity through the venturi or air flow passageway, the vacuum signal being usable for improving fuel delivery characteristics to the venturi as well as for other purposes. Several methods for incorporating the present invention into existing carburetor constructions are likewise disclosed.

25 Claims, 10 Drawing Sheets

FUEL DELIVERY MEANS FOR CARBURETORS FOR INTERNAL COMBUSTION ENGINES AND METHOD FOR INSTALLING SAME

FIELD OF THE INVENTION

The present invention relates to carburetion devices for internal combustion engines, and more particularly, to improved fuel delivery means for carburetors which substantially improve the performance and efficiency thereof.

BACKGROUND OF THE INVENTION

Typical carburetors for internal combustion engines used in vehicles such as automobiles, aircraft, watercraft, motorcycles and small offroad sport vehicles, and powered devices such as chain saws, lawnmowers, garden equipment, generators, etc., include an air flow passageway having a shape that can be characterized as a venturi shape, that is a shape having a side wall therearound which defines larger cross-sectional end portions and a narrower intermediate portion or throat. This passageway or venturi can include a throttle plate located therein positionable at different angular orientations for regulating the flow of air therethrough, and also a choke plate movable in the same manner for facilitating cold starts. Fuel can be delivered to the venturi through one or more outlets or orifices located on the side wall and also through outlets on a tubular member in some constructions called a booster located in the central portion of the venturi in what is known as the free air stream. The free air stream is that portion of the air flow through the venturi which is not affected by any object in the air flow including the side wall of the venturi itself. The fuel is delivered to the orifice or orifices and to the booster by one or more fuel circuits communicating therewith. The fuel circuits can each include one or more fuel conduits or passageways communicating the orifices with fuel receiving and holding means.

Carburetors are typically of two kinds, one kind being characterized by having a fuel bowl, the delivery of fuel to which is controlled by a float mechanism which operates a fuel inlet valve. The second type is known as a diaphragm carburetor and can have one or more fuel chambers or cavities for holding fuel, the inlet valve regulating the delivery of fuel thereto being controlled by a diaphragm type member.

The fuel flow to the venturi in both float bowl and diaphragm type carburetors is largely dependent upon a pressure differential or pressure drop existing between the air flowing or passing through the venturi, and another pressure, usually atmospheric pressure present in another portion of the carburetor. The pressure in the venturi required to cause fuel flow is a negative pressure or partial vacuum condition produced by the operation of the engine drawing a flow of air from the atmosphere through the venturi. This partial vacuum condition, in turn, acts to draw the fuel through the fuel delivery orifices located in the booster and/or on the side wall of the venturi and into the venturi wherein the fuel mixes with the air and is drawn into the engine. In the float bowl type carburetor, as fuel is drawn from the bowl, the inlet valve opens to replace this fuel when the fuel level in the bowl falls to or below a certain predetermined level, as is well known in the art. In a diaphragm type carburetor, the negative pressure or partial vacuum condition from the venturi operates as a diaphragm activation signal. The diaphragm activation signal is communicated through one or more of the fuel passages to one side of the diaphragm, the opposite side of the diaphragm being typically in communication with atmospheric pressure. The pressure differential acting on the diaphragm causes deflection of the diaphragm towards the vacuum side to operate the inlet valve to cause fuel from the fuel supply to enter the fuel chamber, as is also well known in the art.

Under steady-state conditions, the above-described carburetor constructions provide generally satisfactory performance. However, under changing or dynamic conditions, such systems suffer from several significant shortcomings. For instance, when the throttle plate position is changed so as to provide for a greater flow of air through the venturi, this more open condition causes the partial vacuum condition in the venturi to weaken momentarily, reducing the vacuum signal and causing less, not more, fuel to be delivered to the venturi. This throttle change can also cause some of the atomized or emulsified fuel in suspension in the air stream flowing into the engine to fall out of suspension, resulting in poor combustion and a momentary performance lag from the engine and also increased engine smoking. This smoking problem is particularly noticeable in two cycle engines. The momentary reduction in vacuum signal also causes the activation of the diaphragm to be delayed so as not to react immediately to the greater fuel need, resulting in what is known as a lean shot of air to the engine, which is also undesirable.

Diaphragm type carburetors are sealed devices so as to enable operation at other than an upright or vertical orientation without leakage or spillage of fuel, and as such, do not have what is known as an air bleed system communicating with atmosphere as is typically found in float bowl type carburetors. This air bleed system can act as vacuum breaker or anti-siphon means under certain operating conditions. A shortcoming of diaphragm type carburetors which do not have an air bleed system is that when the throttle plate is suddenly closed, such as during sudden decceleration, without a vacuum break the vacuum signal increases substantially so as to flood the carburetor with fuel. This flooding can cause erratic performance in the operation of the engine known as stumbling and can even cause the engine to stall and die. Furthermore, this sudden vacuum signal increase can cause premature fatigue and reduce the effectivenesss of spring members associated with the inlet valve means of diaphragm carburetors, and can result in excessive wear of the valve seat and needle valve member. This resultant reduction in spring effectiveness and valve wear is especially problematic in multiple carburetor applications wherein the operation of the respective carburetors must be closely synchronized. This problem also makes the selection of jet sizes for the carburetors particularly critical.

Numerous solutions to the above-described vacuum signal related fuel delivery problems have been attempted, but with only limited success. For instance, one approach has been to compensate for erratic or poor vacuum signal by the use of accelerator pump means and the like, different jet sizes and by varying inlet valve spring constants, etc. Another approach has been to attempt to regulate the vacuum signal by the use of means such as an air flow restrictor located on the intake side of a carburetor to regulate intake pressure conditions. Another approach has been to locate one or more fuel delivery orifices so as to be responsive to vacuum conditions at different locations in the venturi and in the air stream therethrough, and so as to be responsive to different throttle plate positions. Still further, fuel injection systems have been used as an alternative fuel delivery means in an attempt to eliminate the above-described problems. However, fuel injection can add complexity and expense; it provides only marginally satisfactory results; and it can lead to additional problems.

In addition to the above-described fuel delivery problems relating to erratic and poor vacuum signal, the known prior art carburetor constructions have suffered from other numerous long standing problems. For instance, choke mechanisms required for cold starting add still further complexity to the carburetor and can be unreliable and require frequent adjustments. The emissions levels of engines aspirated using the known carburetor constructions can be unacceptably high, especially in view of increasing government regulations focusing on emissions. This is particularly problematic in regard to two cycle engines.

In contrast to the above-discussed attempted solutions and alternatives, the present invention provides simple, reliable and inexpensive means for solving the above-described problems which can be incorporated into new carburetor designs and, importantly can be retrofitted into existing carburetors. The present invention can also replace existing fuel delivery means, or it can be used in association therewith.

SUMMARY OF THE INVENTION

The present invention overcomes many of the shortcomings and problems associated with known prior art carburetors and teaches the construction, operation and installation of improved carburetor fuel delivery means which can provide better performance and more efficient operation of internal combustion engines. The present invention can eliminate or at least substantially reduce many of the problems associated with the above-described fuel delivery systems in both float bowl type and diaphragm type carburetors. For example, the present invention can provide fuel delivery which is virtually instantaneous in response to throttle changes. Furthermore, the rate of fuel delivery can be virtually directly proportional to the throttle position and engine load. This responsiveness enables smooth, continuous delivery of fuel in response to engine needs and changing throttle conditions. The present invention further facilitates better air and fuel mixing such that more complete and efficient combustion can be achieved for improved engine performance and lower emissions.

The present invention provides these and other advantages by locating improved fuel delivery means to the carburetor passageway or venturi upstream of the venturi constriction or throat. Furthermore, unlike a conventional fuel booster which can also be located above the venturi constriction, but importantly is located more in the vicinity of the central or free air stream flowing through the venturi, the fuel delivery means of the present invention are located adjacent to the side wall of the venturi. This location is preferred as it places the fuel delivery means in the faster moving air stream adjacent the side wall of the venturi and above the constriction or throat thereof, as discussed below. Importantly, the present invention includes an air flow or control surface having aerodynamic characteristics located on or adjacent to the side wall of the venturi. This aerodynamic air flow or control surface has a shape preferably similar to the shape of the upper surface of an airfoil so that like an airfoil, the air flow over such surface will be accelerated as compared to the free stream velocity in the vicinity of such surface. Here again, the free air stream velocity in the vicinity of the present air flow surface is that velocity of the air flow which is sufficiently spaced from such surface so as not to be affected by the shape of such surface. More particularly, this air flow or control surface will have locations thereon where the air flow velocity thereover is greater or higher than the free air stream velocity. Also importantly, the present invention includes one or more fuel delivery outlets or orifices located on or adjacent to this aerodynamic air flow surface, preferably at the location on the surface where the velocity thereover is greatest or at least in the vicinity thereof.

It has been observed that the fuel delivery means constructed according to the present invention can provide a vacuum signal enabling the introduction of fuel to the air stream moving through the venturi virtually directly proportionally to the air velocity over the air flow or control surface. It has also been observed that the air velocity over this surface closely corresponds to the throttle position and engine demand, so as to enable the present means to provide fuel virtually directly in response to changes in throttle position, engine load, etc., without performance lags, stalling, hesitation and the like.

Furthermore, it has been experimentally determined that the present invention produces a vacuum signal corresponding in strength with the air flow velocity thereover and which vacuum signal is substantially greater than that provided by conventional boosters and other fuel delivery circuits. The vacuum signal provided by the present invention has been found to be so much greater, in fact, that fuel communicated through the fuel delivery outlet or outlets enters the moving air stream through the venturi as more of a vapor than as an atomized or emulsified stream, as compared with conventional fuel delivery means. It is believed that this vaporized fuel provides a better air fuel mix for improved combustion and efficiency, and lower emissions. It is also believed that locating the present fuel delivery means upstream of the venturi constriction enables the vaporized fuel to be accelerated through the constriction due to the increased air flow velocity therethrough to provide a better air fuel mixture. Still further, in two cycle engines wherein the fuel includes oil for lubricating the engine, better lubrication of the engine has been observed using the present invention.

Another advantage of the present construction is its adaptability for use in a wide variety of carburetor constructions and designs. The present construction can be incorporated for use in carburetors for both four cycle engines and also two cycle engines. The present construction can also be used as the sole fuel delivery means, or alternatively, in association or cooperation with existing or other fuel delivery means such as boosters, etc. For instance, the present invention can be used to provide a vacuum signal for priming or otherwise improving or enhancing the vacuum signal, responsiveness, and other fuel delivery characteristics of primary and intermediate or bypass fuel circuits of a carburetor.

The present construction can be incorporated into entirely new carburetor designs, and it can also be readily incorporated and retrofitted into existing carburetor designs and units. In this regard, the present fuel delivery means can be incorporated into a carburetor using, for instance, an existing surface on the carburetor side wall as the air flow or control surface which has suitable aerodynamic properties. Alternatively, the present invention can include a new surface mounted or otherwise located in the venturi. Further, a fuel delivery orifice or outlet according to the present invention can include means associated therewith for metering the fuel flow therethrough, such as a jet, needle valve, and the like, and the fuel delivery orifice can be located on a movable member such as a threaded member which can be moved relative to the carburetor passageway for adjusting the fuel delivery characteristics. The movable member can also be interchangeable with other members having orifices of different shape, size or other parameters.

Still further, additional aerodynamic surfaces and orifices can be used in association with other fuel delivery circuits of a carburetor such as the primary or intermediate circuit which can be located elsewhere in a venturi, such as adjacent to or below the throat or constriction. The present invention also has utility for delivering any liquid to a moving air or gas stream. For instance, the present invention can be used for delivery of oil to the air stream or to the air fuel mixture in a two cycle engine. Utility is also foreseen for use in association with fuel injection systems and in chemical processing, manufacturing and other applications. For instance, the invention can be used as a supplementary vaporizing fuel source in association with both throttle body type and port type fuel injection systems.

OBJECTS OF THE INVENTION

It is therefore an object of the present invention to improve the operation and performance of internal combustion engines.

Another object is to improve throttle response of internal combustion engines, and more particularly, to substantially reduce or eliminate performance lags, flooding, hesitation, stumbling and stalling due to poor or erratic carburetor vacuum signals.

Another object is to make internal combustion engines more efficient and reduce undesirable engine emissions.

Another object is to teach fuel delivery means for a carburetor which provides virtually instantaneous response to changes in throttle position and engine demand.

Another object is to provide a better air fuel mixture for internal combustion engines.

Another object is to provide improved fuel delivery means for carburetors which can replace conventional fuel delivery means and, alternatively, can be used in cooperation therewith.

Another object is to eliminate the need for intake flow restrictors, boosters and other conventional means which obstruct or reduce the air flow through a carburetor.

Another object is to improve the synchronized operation of multiple carburetor sets.

Another object is to provide improved fuel delivery means usable with a wide variety of carburetor constructions.

Another object is to provide improved fuel delivery means which can be used with both two cycle and four cycle internal combustion engines.

Another object is to provide improved fuel delivery means for carburetors which are economical and which can be incorporated into both existing carburetors as well as new carburetor designs.

These and other objects and advantages of the present invention will become apparent to those skilled in the art after considering the following detailed specification in conjunction with the accompanying drawings wherein:

BRIEF DESCRIPTION OF THE DRAWINGS

FIG. 4*b* is a graph comparing the horsepower output over time of an internal combustion engine using the carburetor of FIGS. 3*a*–3*c* and using the carburetor modified as shown in FIG. 4*a.

DETAILED DESCRIPTION OF THE PREFERRED EMBODIMENTS

Figure 1:
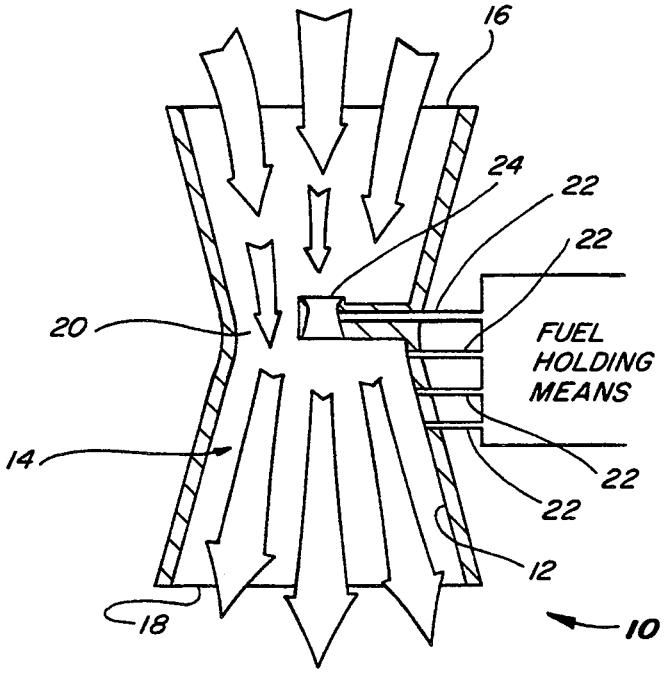
PRIOR ART Fig. 1
FIG. 1 is a cross-sectional representation of a typical prior art carburetor venturi construction showing in diagramatic form an air stream flowing therethrough, and showing typical fuel holding means associated therewith.
Figure 3A:
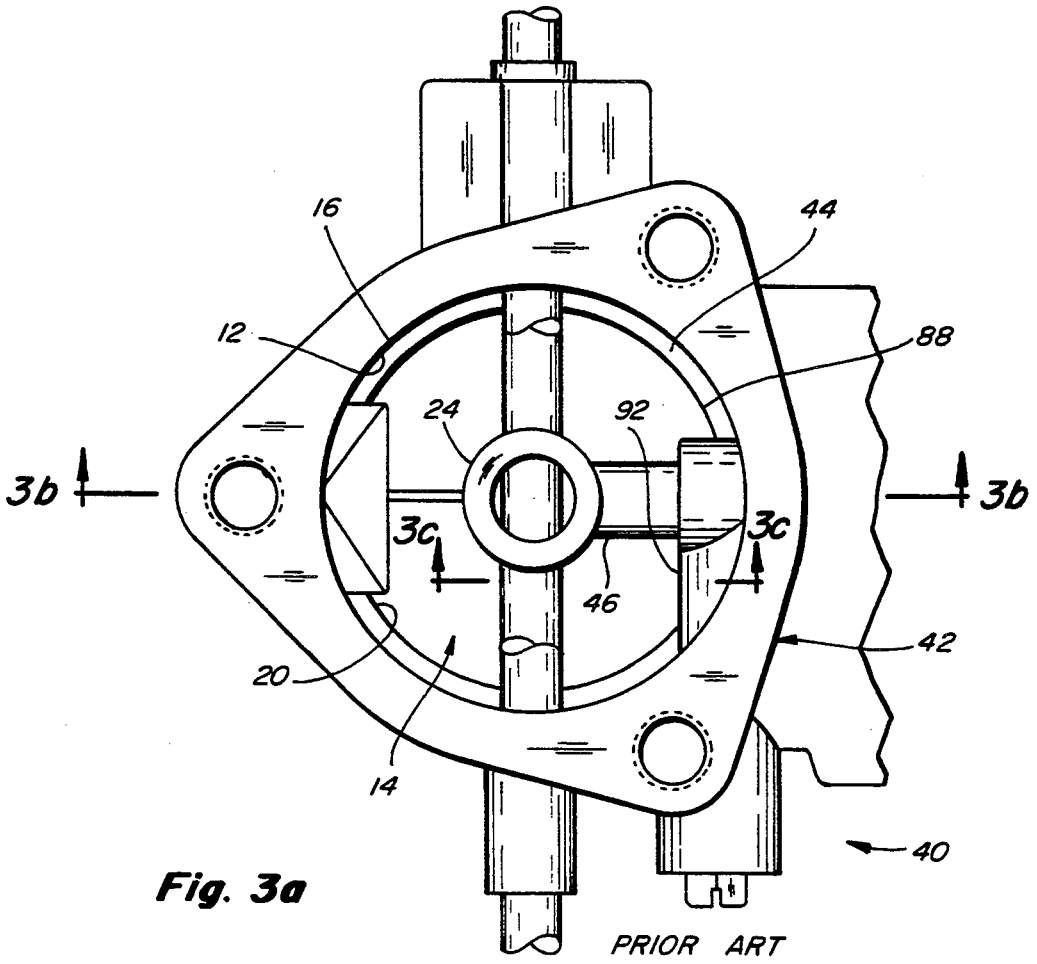
Fig. 3a PRIOR ART
FIG. 3*a* is a top view looking through the air flow passageway of one prior art diaphragm type carburetor construction showing the choke plate thereof removed.

Referring to the drawings more particularly by reference numbers wherein like numerals refer to like parts, FIG. 1 shows a venturi construction 10 representative of both conventional prior art float bowl and diaphragm type carburetor devices typically used in association with gasoline powered engines for vehicles such as automobiles, motorcycles, aircraft, watercraft, offroad sport vehicles, and other internal combustion engine powered devices. The venturi 10 includes a continuous side wall 12 defining a passageway 14 extending between opposing inlet and outlet openings 16 and 18, respectively. A defining characteristic of the venturi construction 10 is the shape of the walled structure thereof which defines a narrower or more constricted intermediate or throat portion 20 in the passageway 14. The venturi 10 operates according to the well known principles wherein a stream of air entering the venturi 10 through the inlet opening 16 will experience an increase in velocity and a decrease in pressure when passing through the constricted or throat portion 20, and the stream of air will exit through the outlet opening 18. Prior art fuel delivery means are shown in association with the venturi 10 and include a plurality of passages 22 communicating a fuel source with the passageway 14. A booster 24 is also located centrally in the passageway 14. Fuel from the fuel source enters the passageway 14 through the passages 22 in response to a pressure differential between a pressure condition in the passageway, usually a negative pressure or partial vacuum condition, and another higher pressure, usually atmospheric pressure, present in another portion of the carburetor. The fuel mixes with the air flowing through the venturi and the air fuel mixture then exits the venturi via the outlet opening 18 whereupon it can enter the intake means of an internal combustion engine (not shown). Shortcomings associated with the prior art fuel delivery means such as shown in FIG. 1 have been discussed in detail above and can include performance lags, lean operation, stumbling, hesitation and the like, and also excessive smoking and other emissions.

Figure 2:
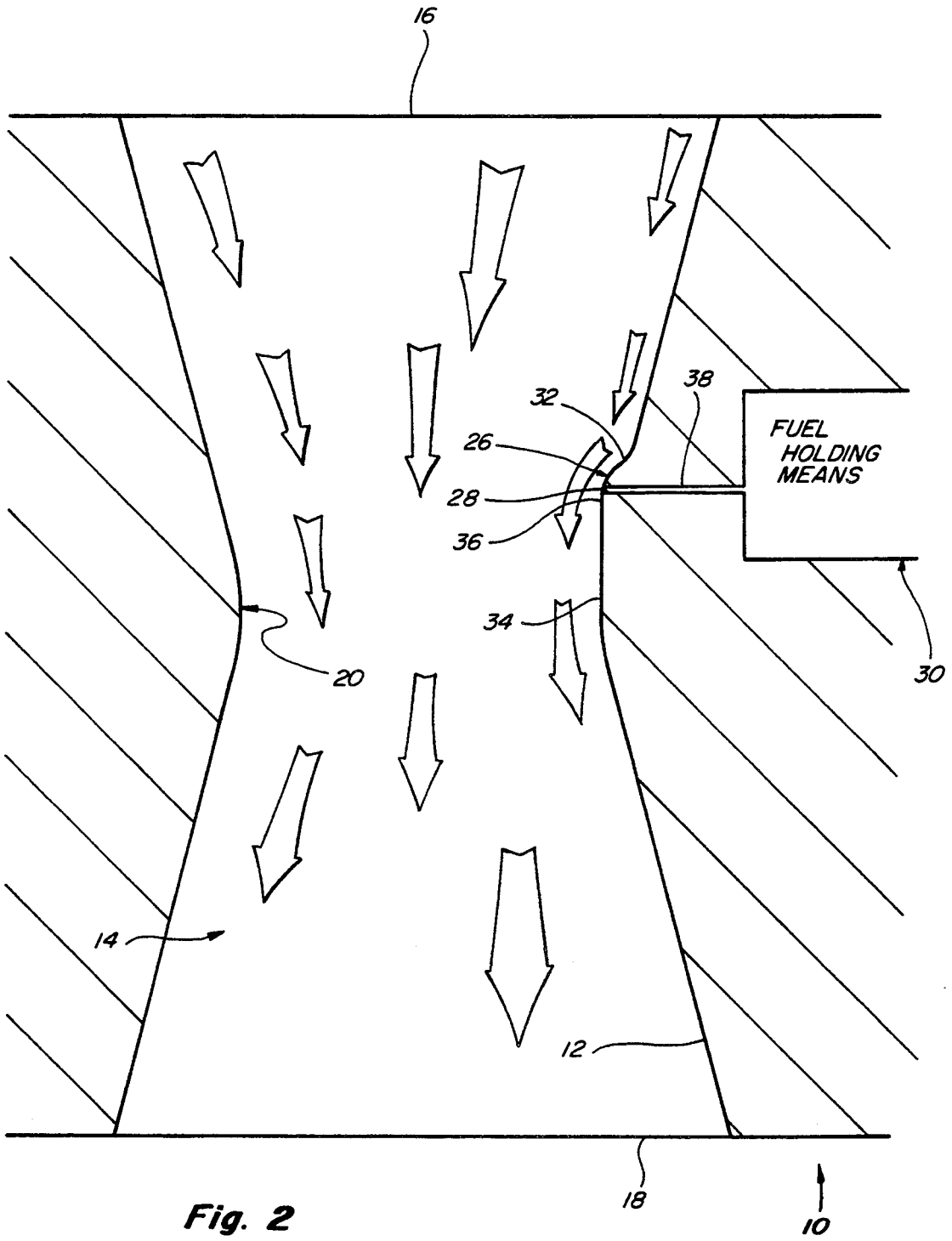
FIG. 2 is an enlarged cross-sectional view of the prior art venturi construction of FIG. 1 showing the present invention associated therewith.

Referring to FIG. 2, the venturi 10 of FIG. 1 is shown modified to incorporate one embodiment of the present improved fuel delivery means thereon for overcoming the above-discussed shortcomings and problems associated with the prior art fuel delivery means. The present invention includes an air flow surface 26 which has aerodynamic characteristics providing enhanced air flow velocity thereover, and a fuel delivery orifice 28 communicating with fuel source means such as shown at 30. The air flow surface 26 is located adjacent the side wall 12 of the venturi 10 and also adjacent the inlet or upstream side of the throat portion 20. The aerodynamic surface 26 includes a leading end or upstream portion 32, a trailing end or downstream portion 34 located opposite the leading end 32, and a surface portion 36 located between the leading and trailing end portions where the air flow velocity will be greater than at other locations on the air flow surface, as discussed next. The air flow surface 26 preferably has a profile having a shape similar to that of the upper surface portion of an airfoil and forms a wing shape, which wing shape can be varied for different carburetor constructions and applications.

The exact location in the venturi for locating the optimal aerodynamic air flow surface 26, its angle of attack, as well as other parameters of the optimal aerodynamic air flow surface can be determined for a particular carburetor application based on the desired operational and performance characteristics sought therefor. According to well known aerodynamic principles for instance, the velocity of an air stream flowing over the upper surface of an airfoil will be higher or greater than free stream velocity at various locations along the upper surface of such airfoil, the air flow over such airfoil being greatest at one particular point or location on such airfoil. Furthermore, according to the principles governing air flow through a venturi, the velocity of the air flow into the throat or constricted portion thereof, such as the portion 20 illustrated in FIG. 1, will be greater adjacent the side wall than in the vicinity of the center of the air stream. Therefore, it is believed that locating a surface having aerodynamic characteristics as discussed above upstream of the constriction or throat of the venturi and adjacent the side wall thereof takes advantage of both of these principles and provides a surface portion or region 36 on the aerodynamic surface 26 where the velocity is greater relative to the free stream velocity thereover and higher relative to the air flow over other portions of the venturi surface. The orifice 28 (FIG. 2) is preferably located in this greater velocity region 36. Although locating the orifice 28 at the point of maximum air flow velocity over the surface 26 is ideal, all of the objects and advantages of the present invention are achieved as long as the orifice 28 is located anywhere on the aerodynamic surface 26 where the velocity of the air flow over the surface is greater than free stream velocity.

Locating the fuel delivery orifice 28 in the higher velocity surface region 36 has been found to provide much better fuel delivery characteristics than can be provided by fuel delivery outlets located for instance in a centrally located booster such as the booster illustrated in FIG. 1 at 24, and also better than fuel delivery outlets at other locations along the venturi wall such as in the vicinity of the constriction 20 or downstream therefrom. For instance, in the Mikuni carburetor construction discussed next and which includes a fuel booster and also fuel delivery outlets located on the side wall of the venturi below the constriction, the negative pressure conditions communicated through the orifice 28 according to the present invention were found to be substantially greater than the vacuum signal communicated from the fuel booster and from any of the other prior art fuel delivery outlets under the same operational conditions. It was also observed that the vacuum conditions through the orifice 28 according to the present invention varied virtually directly with throttle position and engine load, and that the rate of fuel delivery also corresponded virtually directly with throttle and engine load. This resulted in engine performance which was free of lags, hesitation and stumbling, and also resulted in less emissions and less smoking.

The various parameters such as the size and shape of the present orifice 28 can be varied, and the conduit communicating therewith can be positioned at angular orientations relative to the surface 26 and to the air stream moving thereover so as to provide desired fuel delivery characteristics. The orifice 28 communicates with a fuel source means 30 via one or more conduits or passages such as the conduit 38, and which will be described in greater detail in reference to specific embodiments discussed below.

Referring now to specific embodiments of the present invention, FIGS. *3a, 3b* and *3c* show a typical diaphragm type carburetor construction 40 made by Mikuni Corp. of Japan. The Mikuni carburetor 40 includes an outer body portion 42 providing the side wall structure 12 defining the passageway 14 extending between the inlet opening 16 and the outlet opening 18 as discussed above. The outer body portion 42 further includes a generally annular shaped portion 44 extending into the passageway 14 intermediate the inlet and outlet openings 16 and 18 forming a venturi constriction or throat 20. The carburetor 40 includes a booster 24 located centrally in the passageway 14 adjacent the throat 20. The booster 24 is supported in the passageway by a support structure 46.

Referring more particularly to FIG. *3b*, fuel is delivered to the Mikuni carburetor 40 from a fuel source (not shown) through an inlet opening 48 and is communicated through a passageway 50 to an inlet needle valve 52 through which the fuel must pass to enter a main fuel chamber 54. The main fuel chamber 54 is enclosed on one side by a diaphragm member 56. A diaphragm cover member 57 covers and protects the diaphragm member 56, and includes a hole 59 therethrough to communicate atmospheric pressure to the side of the diaphragm opposite the fuel chamber 54. The diaphragm member 56 controls the inlet needle valve 52 via a control arm 58 which operates in counteraction to a control arm spring 60 which has very precise spring constant characteristics. A fuel metering block 62 separates the main fuel chamber 54 from additional fuel chambers including an upper fuel chamber 64 and a lower fuel chamber 66, the respective upper and lower fuel chambers being separated from one another by a rubbery gasket member 68. Fuel is communicated from the main fuel chamber 54 to the upper and lower fuel chambers 64 and 66 through a passageway 70 in the metering block 62, the fuel being allowed to flow into the upper fuel chamber 64 from the passageway 70. A flapper type valve 72 prevents the backflow of fuel through the passageway 70. Fuel located in the lower fuel chamber 66 can pass through a pilot jet 74 into a low and intermediate speed fuel circuit wherein fuel can be delivered into the venturi passageway 14 through a pilot outlet 76, the flow rate through which is controlled by a low speed needle valve 78. Fuel can also flow from this fuel circuit into the venturi passageway through a bypass outlet 80. Fuel in the upper fuel chamber 64 can pass through a main jet 82 and through a high speed adjusting circuit controlled by a high speed needle valve 84, and through a booster entry conduit 85 to a main outlet 86 on the booster 24.

The Mikuni carburetor construction 40 further includes a throttle butterfly valve including a throttle plate 88 mounted for rotation in the passageway 14 adjacent the outlet opening 18 for regulating the air flow through the passageway 14 and a choke butterfly valve including a choke plate 90 mounted for rotation therein adjacent the inlet opening 16 for regulating the air flow under cold temperature conditions. In operation, when the throttle plate 88 is in a first position, as shown in solid lines in FIG. *3b*, only a very small amount of air flow passes through the passageway 14 past the throttle plate 88. This air flow, for instance, is sufficient for maintaining an engine on which the carburetor is mounted at an idle speed. Fuel is delivered into the air stream through the primary outlet 76 responsive to the pressure differential between the vacuum signal provided therethrough and the atmospheric pressure on the opposite side of the diaphragm 56. As the position of the throttle butterfly valve is changed, for instance to the position shown at 88', additional fuel is supplied through the bypass outlet 80 responsive to the additional vacuum signal provided therethrough. Still further, when for instance the throttle butterfly valve is positioned such as at 88" which corresponds to a wide open throttle position, even more air flows through the passageway 14 and also through the booster 24. This provides a booster vacuum signal through the main outlet 86 for delivery of fuel to the air stream through the booster 24.

When the throttle plate is suddenly moved from the position shown at 88 to the position shown at 88", the vacuum signal through the pilot outlet 76 is momentarily disrupted or lost due to the sudden exposure of the pilot outlet 76 to the greater or atmospheric pressure nearer the inlet end of the venturi, and an insufficient vacuum signal still exists through the bypass outlet 80 and the main outlet 86, resulting in a momentary fuel starvation condition and a performance lag. As another example, when the throttle plate is moved from the position shown at 88" to the position shown at 88, a sudden surge of vacuum signal is provided through the pilot outlet 76 so as to suddenly deflect the diaphragm member 56 in counteraction to the control arm spring, resulting in a sudden opening of the inlet fuel valve 52 and a flooding condition which results in engine stumbling and other problems. Furthermore, the control arm spring 60 can decrease in effectiveness due to fatigue and other conditions resulting from such sudden changes in vacuum signal. This sudden deflection can also cause excessive wear on the other fuel inlet valve components such as on the valve member itself and on the valve seat of the inlet valve 52 so as to enable leakage therearound resulting in poor operation thereof. These problems are particularly significant with regard to applications using multiple carburetors which must operate in close synchronization. For instance, in some multiple carburetor applications, the respective forces for opening the inlet valves must be within one half pound of one another for proper synchronized operation. Spring fatigue over time can cause these pressures to vary widely.

The present invention can overcome or at least significantly reduce the above-discussed shortcomings and problems associated with the Mikuni carburetor construction 40. Importantly, one embodiment of the present invention can be readily and easily incorporated into existing Mikuni carburetor constructions. Referring to FIGS. *3a* and *3c*, the Mikuni carburetor includes a portion 92 on the outer body portion 42 located adjacent to the support structure 46, which extends into the passageway 14 adjacent the inlet side of the throat portion 20. The body portion 92 has an outer surface adjacent the passageway 14 which has aerodynamic characteristics sufficiently suitable to enable serving as the air flow surface 26.

Figure 4A:
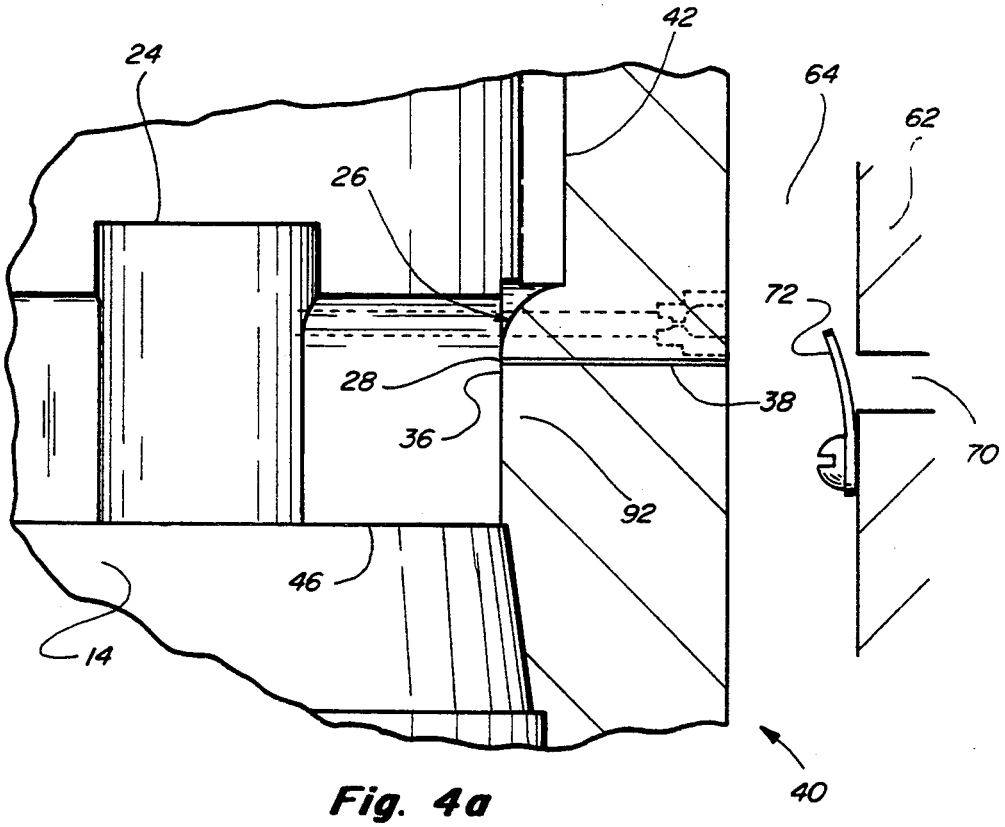
FIG. 4*a* is an enlarged fragmentary cross-sectional view of the carburetor construction of FIG. 3*a,* similar to FIG. 3*c,* and showing one embodiment of the present invention associated therewith.

Referring to FIG. 4*a*, the outer surface of the body portion 92 is shown utilized as the air flow surface 26. In this embodiment, the fuel delivery orifice 28 can be provided on the air flow surface 26 of the body portion 92 in communication with a fuel delivery conduit or passage 38 leading to the upper fuel chamber 64. The fuel delivery orifice 28 is located in the vicinity of what has been determined to be the region 36 of higher air flow velocity over the air flow surface 26. The air flow over the surface 26 generates a vacuum signal which is communicated through the orifice 28 and the passage 38 to the upper fuel chamber 64. As discussed above, this vacuum signal is virtually directly proportional to the velocity of the air flow over the surface 26, which air flow velocity is dependent on throttle position, engine load and other factors. Further, this vacuum signal has been measured to be much stronger than the vacuum signals through the other fuel delivery circuits. The vacuum signal is so much stronger that it causes fuel drawn from the upper fuel chamber 64 through the passage 38 and out the fuel delivery orifice 28 to enter the air stream moving through the venturi in what appears to be a vapor state, not in droplets or an atomized state as observed with the conventional fuel delivery means.

Figure 4B:
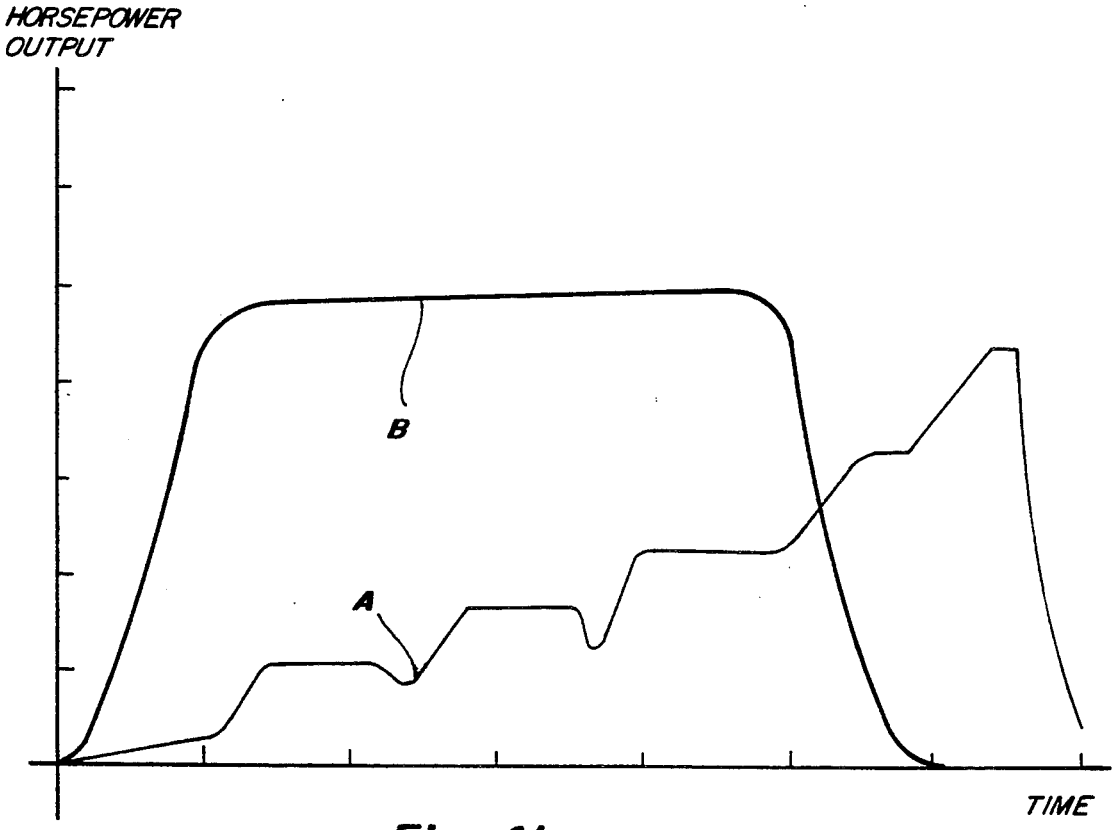

To illustrate the benefits of incorporating the present invention on the Mikuni carburetor construction 40, reference is made to FIG. 4*b* which compares the horsepower output of an internal combustion engine using a Mikuni carburetor without the above-described modification and one using a Mikuni carburetor incorporating the above-described embodiments of the present invention therein. The vertical axis or ordinate represents horsepower, and the horizontal axis or abscissa represents time. The horsepower output of the engine without the present invention is shown by the curve identified by the letter A. The horsepower output for the engine incorporating the present invention is represented by the curve identified by the letter B. Comparing horsepower output curves A and B, it can be seen that the engine modified according to the present invention reaches maximum horsepower faster and much more smoothly than the standard engine and without performance lags and other problems.

Figure 4C:
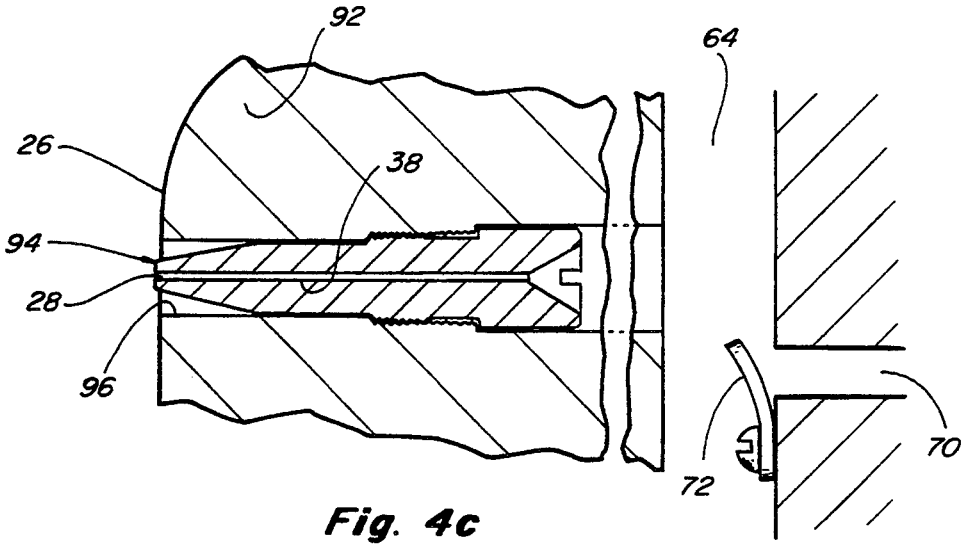
* and FIG. 4*c* is a fragmentary cross-sectional view of the carburetor of FIG. 3*a,* also similar to FIG. 3*c,* and showing another embodiment of the present invention associated therewith.

To enable adjusting or varying the performance and other characteristics provided by the present invention, the fuel delivery orifice 28 and the passageway or conduit 38 can be located on movable or adjustable means, such as on the threaded member shown at 94 in FIG. 4*c*. The threaded member 94 is threadedly mounted in a bore 96 extending from the upper fuel chamber 64 to the aerodynamic air flow surface 26. This construction enables positioning the fuel delivery outlet 28 on the end of the threaded member 94 at different locations relative to the air flow surface 26, and also enables the interchangeability of threaded members having different parameters such as different sized and shaped conduits 38. The threaded member 94 further preferably has a conical shape end adjacent the air flow surface 26, which has been found to provide better wearability.

Figure 3B:
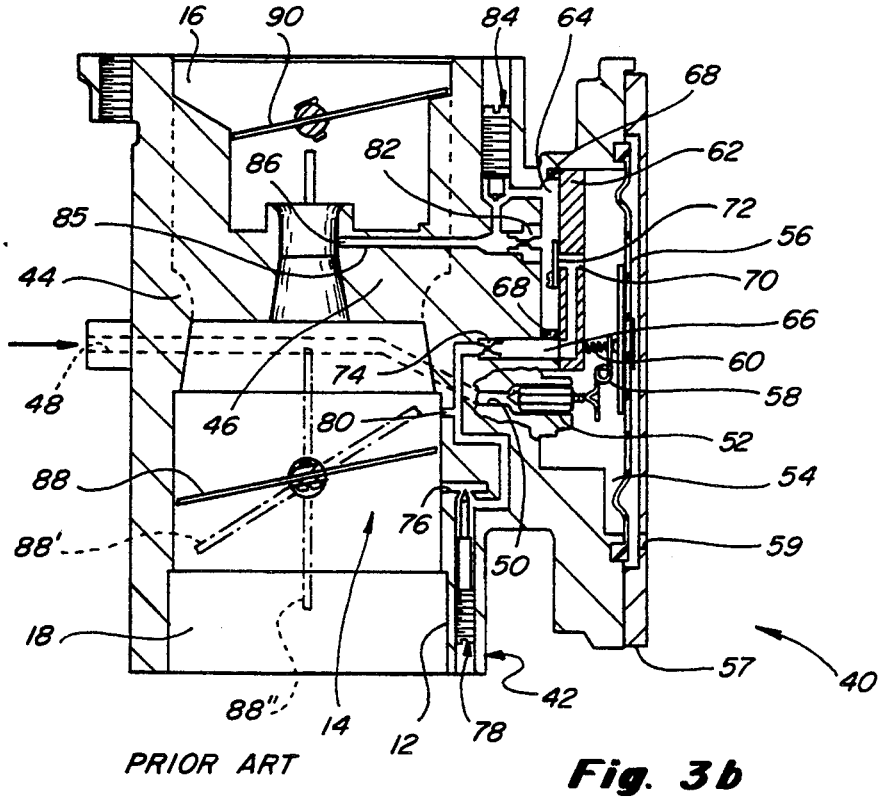
PRIOR ART Fig. 3b
FIG. 3*b* is a cross-sectional view taken along line 3*b*—3*b* of FIG. 3*a* and showing the choke plate in place on the carburetor.
Figure 3C:
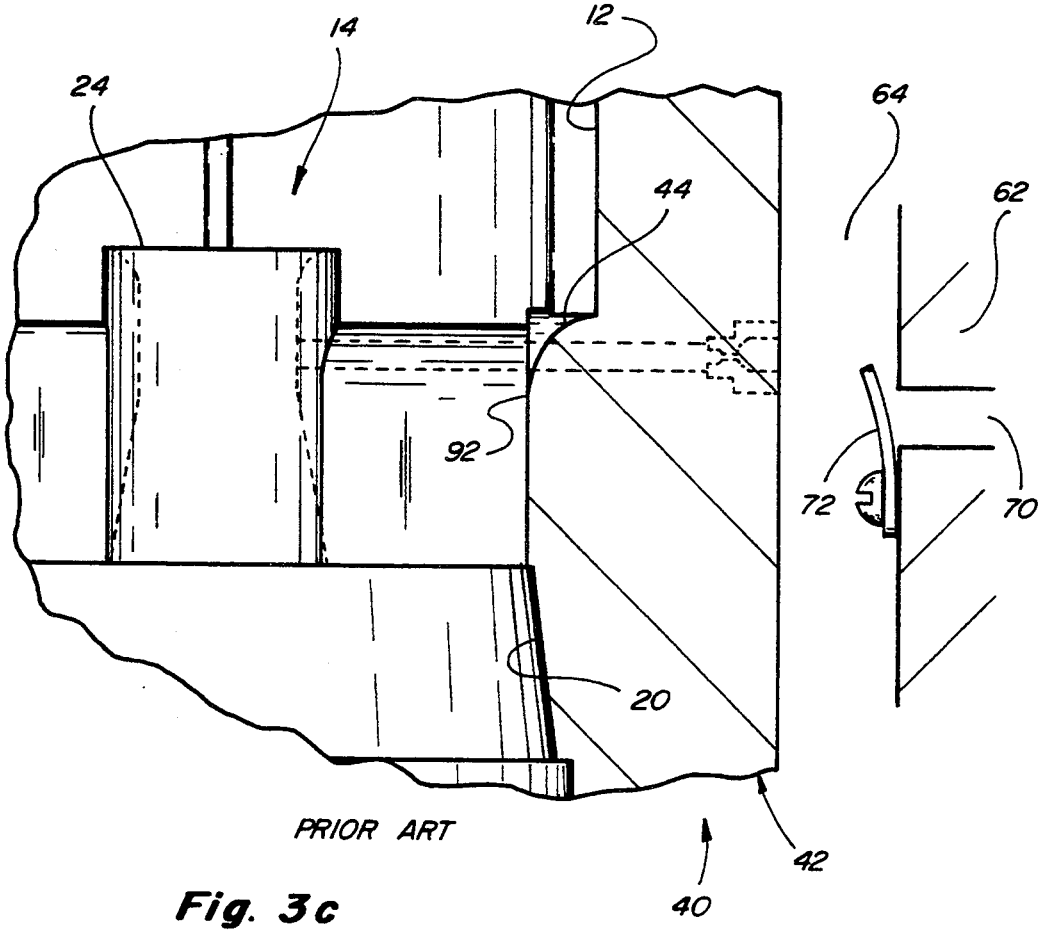
PRIOR ART Fig. 3c
FIG. 3*c* is an enlarged fragmentary cross-sectional view taken along lines 3*c*—3*c* of FIG. 3*a;*

Referring to FIG. 3*b*, the above-described embodiment of the present invention can be incorporated into the Mikuni carburetor construction 40 by removing the diaphragm cover 57, the diaphragm member 56, and the metering block 62. Referring now to FIG. 4*a*, one can drill a hole through the body portion 42 and through the portion 92 thereof from the upper fuel chamber 64 to the desired location on the surface 26 of the body portion 92 in the higher velocity region 36. The size of the hole can correspond to the desired size of the fuel delivery conduit 38 and orifice 28, or alternatively, it can be sufficiently large to serve as the bore 96 for receiving the threaded member 94. The above-listed components can then be reinstalled after the residue from the drilling operation is removed to ready the carburetor for operation.

Other carburetor constructions can be modified to incorporate the present invention in a manner similar to that just described wherein the air flow surface 26 can comprise an existing surface located in the venturi of the carburetor. For instance, as discussed in reference to FIG. 9 below, a typical float bowl type carburetor is shown modified as discussed above. Alternatively, the air flow surface 26 can comprise a surface formed on, mounted on, or otherwise installed in the carburetor venturi using any suitable means. Furthermore, the size, shape, angle of attack and other parameters of the aerodynamic surface 26, as well as the orientation and other parameters of the orifice 28 and related fuel delivery conduit can be determined based on the desired operational and performance characteristics for a particular application. It may also be desirable in a particular application to provide one or more fuel delivery orifices on one or more air flow surfaces at different locations in the venturi. Still further, the teachings of the present invention can be incorporated into a carburetor device in cooperation with one or more existing fuel delivery circuits such as a main circuit, a primary circuit, or an intermediate circuit to enhance and/or supplement the fuel delivery characteristics provided thereby as discussed next.

Figure 5A:
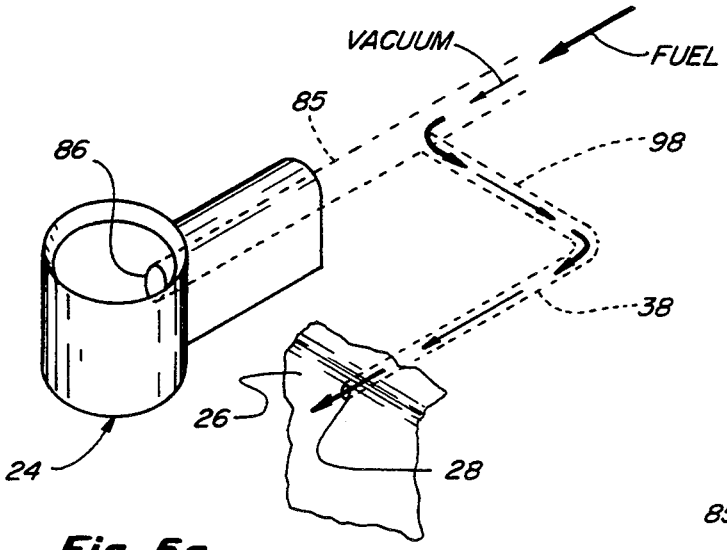
FIGS. 5*a,* 5*b* and 5*c* are each digramatic representations showing the present invention in association with a prior art fuel delivery circuit for a booster member and showing how the present invention affects the operation thereof.
Figure 5B:
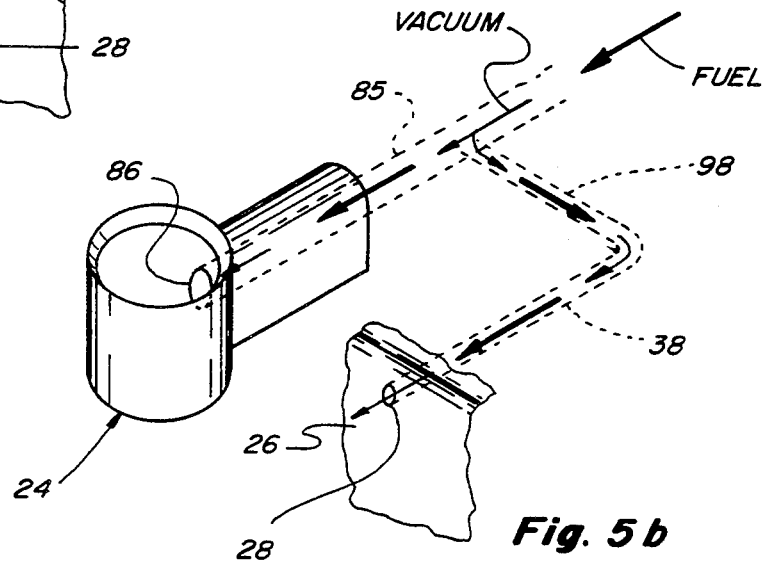
Figure 5C:
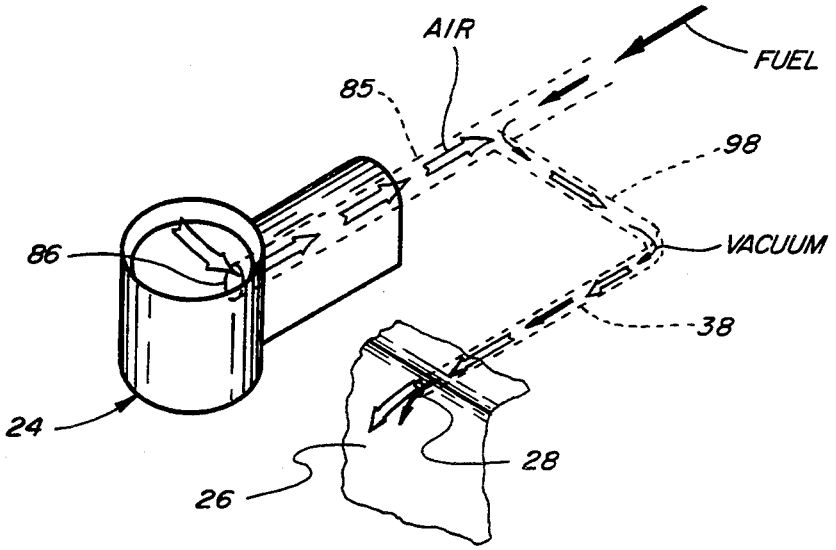

Referring to FIGS. 5*a*, 5*b* and 5*c*, means for enhancing the vacuum signal from a booster 24 are shown. The means according to the present invention include the aerodynamic air flow surface 26, an orifice 28 located on the surface 26, and a passageway 38 communicating with the orifice 28. The booster fuel delivery circuit includes a booster entry conduit 85 which communicates with a main fuel outlet 86 in the booster 24. The booster entry conduit 85 will typically be larger in cross-section than the passageway 38, as shown.

Referring more particularly to FIG. 5*a*, under low air usage conditions, such as corresponding with an idle condition or the like, the vacuum condition in the booster 24 will be relatively low, typically under these conditions so low as to be insufficient for drawing fuel therethrough, partly due to the relatively large size of the booster entry conduit 85. The means taught by the present invention, on the other hand, under such conditions have a relatively higher vacuum signal therethrough which corresponds to the air flow velocity over the air flow surface 26, and also corresponding in part to the relatively small size of the passageway 38. Importantly, this vacuum signal (represented by a thin black arrow) from the passageway 38 is communicated through the connecting conduit 98 to the booster entry conduit 85. This acts to increase the vacuum signal in the booster entry conduit 85 sufficiently to draw fuel (represented by the thick black arrow) into the conduit 85 for priming the main fuel circuit. Referring to FIG. 5*b*, when the air velocity through the venturi increases, such as due to sudden increase in throttle demand, the primed main fuel circuit will be able to react faster to the changing throttle position to enable faster fuel delivery to the booster. The vacuum signal through the conduit 38 will also increase under such conditions, such that some amount of the fuel from the main fuel circuit will still be diverted through the connecting passageway 98 to the passageway 38. However, due to the relatively smaller size of the passageway 38, fuel can still be directed to the booster 24.

Referring to FIG. 5*c*, at all times during operation the vacuum signal through the orifice 28 is greater than the vacuum signal through the main fuel outelt 86. During idle and partial throttle conditions, this difference in vacuum signal strength may be sufficient such that the flow direction through the booster entry conduit 85 between the connecting passageway 98 and the main fuel outlet 86 is reversed such that air (represented by the white arrow) can be drawn from the booster into the conduit 85 and into the passageway 98. This air can pass through the connecting passageway 98 into the passageway 38 along with fuel so as to provide an emulsified air fuel mixture flowing from the connecting passageway 98 through the passageway 38 and out the fuel delivery outlet 28. As the booster vacuum signal increases, such as due to increased throttle and as the passageway 98 and 38 become saturated with fuel, this reversal will receed and fuel will flow to the booster through the conduit 85 as shown in FIG. 5*b*. The circuit as just described can also provide an air bleed or vent for the main fuel circuit during sudden deccelerations and the like.

Figure 6:
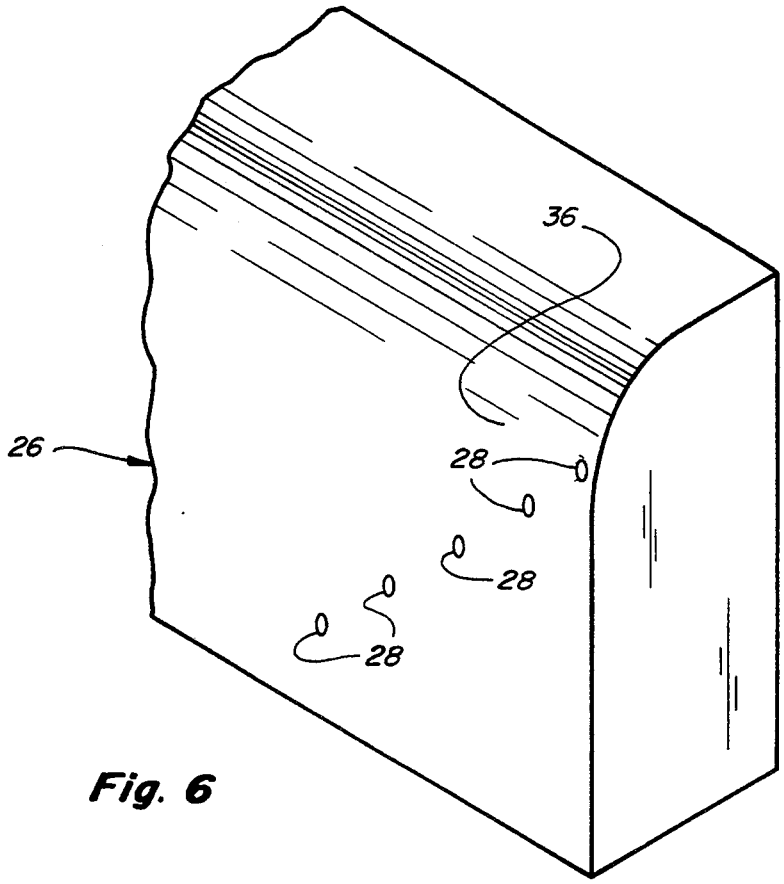
FIG. 6 is a fragmentary perspective view of an air flow surface having a plurality of orifices associated therewith in accordance with the teachings of the present invention.

Another feature of the present invention is the ability to locate one or more fuel delivery outlets 28 on the air flow surface 26 at locations other than at the point of greatest velocity thereover, as well as at locations other than at the region of higher velocity, as shown in FIG. 6. The relative vacuum signal through the respective fuel delivery outlets 28 would be responsive to the air flow velocity thereover, an outlet located in closer proximity to the point of greatest velocity or within the higher velocity region likely providing a stronger vacuum signal, and the one or more other outlets providing weaker vacuum signals.

To facilitate incorporation of the present invention into existing carburetor constructions and interchangeability for providing different performance parameters and serviceability, the present invention can be incorporated into means which can be installed or retrofitted on a carburetor. Such means can include, for instance, an insert member of cast metal or other suitable construction sized and shaped so as to be mountable on the side wall of a venturi or alternatively cooperatively received in a receptacle formed therein, such as by machining. The insert member can be secured to the carburetor using any suitable means, such as using machine screws, adhesives or the like.

Figure 7:
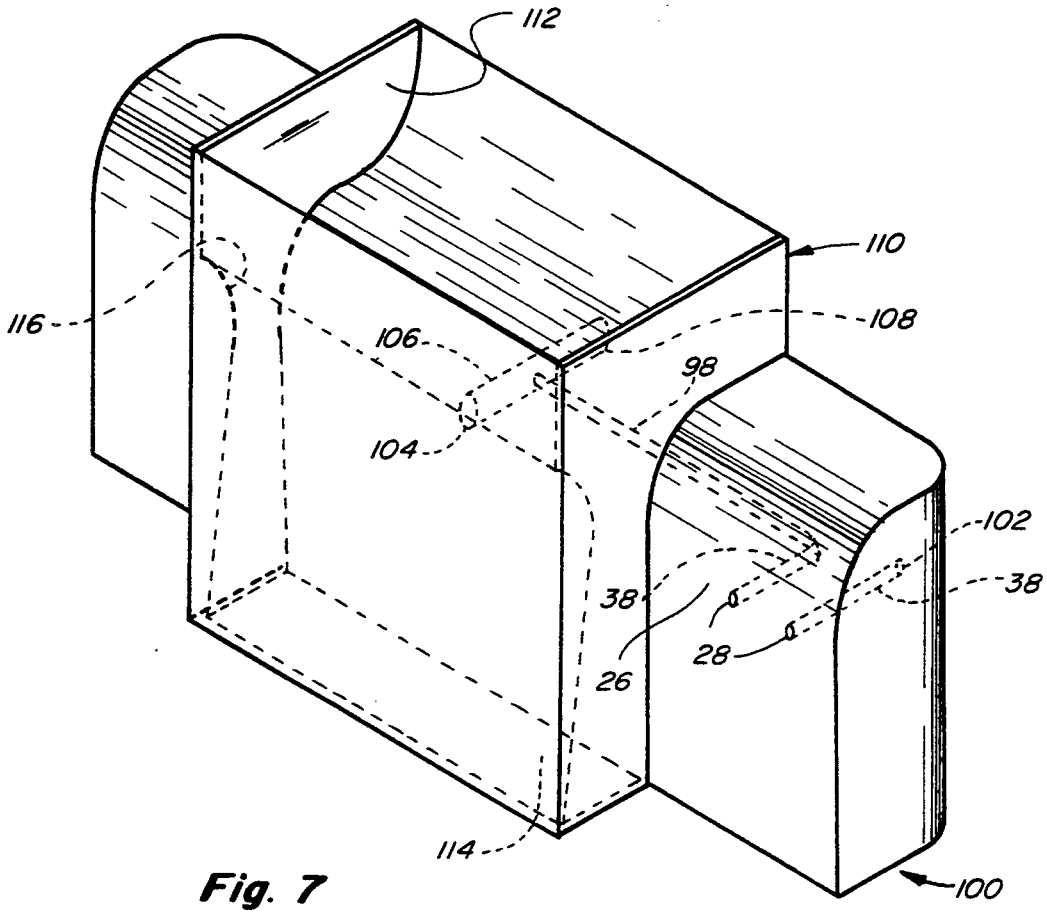
FIG. 7 is a perspective view of an insert member constructed according to the teachings of the present invention.

Referring to FIG. 7, one embodiment of an insert member is shown at 100. The insert member 100 is adapted to be cooperatively received in a cavity formed in the side wall of a carburetor venturi (not shown). The insert member 100 includes an air flow surface 26 on one side thereof and a first orifice 28 communicating with a passageway 38 which extends through the insert member to an opening 102 on the opposite side thereof. The opening 102 is positioned and located on the insert member 100 so as to communicate with a passageway through a carburetor body to the fuel chamber thereof when the insert member 100 is installed thereon. The insert member 100 also includes means for replacing the booster member 24 of a carburetor, including a main fuel outlet 104 located on the surface 26 and communicating with a main fuel conduit 106 which extends to an opening 108 on the opposite side of the insert member. The opening 108 is located and positioned so as to communicate with the remaining portion of the booster entry conduit 85 when the insert member 100 is installed. An optional circuit including a second orifice 28 communicating with the main fuel conduit 106 via a passageway 38 and a connecting conduit 98, as taught above, is also included. Furthermore, the main fuel outlet 104 is located in an optional duct 110 for improving the air flow characteristics thereover. The duct 110 includes an inlet opening 112, an opposite outlet opening 114, and an inner surface 116 opposite the aerodynamic air flow surface 26, which inner surface 116 can have an aerodynamic, a curvilinear or other desired shape.

Figure 8:
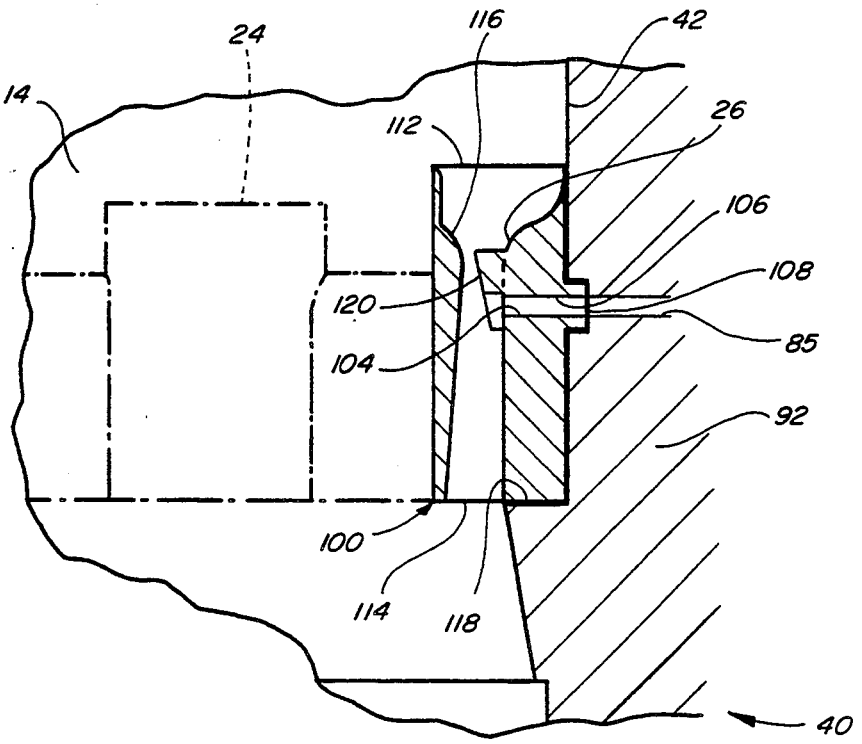
FIG. 8 is an enlarged fragmentary cross-sectional view of the prior art carburetor construction of FIG. 3*a,* similar to FIG. 3*c,* and showing in cross-section the insert member of FIG. 7 installed thereon.

Referring to FIG. 8, the insert member 100 is shown installed on a Mikuni carburetor construction 40 in place of the booster member 24 which was removed. The phantom outline of the booster member 24 is shown in FIG. 8 for illustrative purposes only. The insert member 100 is shown mounted in a receptacle 118 formed in the body member 42 with the main fuel conduit 106 in communication with the remaining portion of the booster entry conduit 85. The insert member 100 is also shown including an optional crossbar member 120 adjacent the main fuel outlet 104 for improving the air flow characteristics thereover, which crossbar 120 can extend completely or only partially across the duct to the opposite surface 116, as desired.

Figure 9:
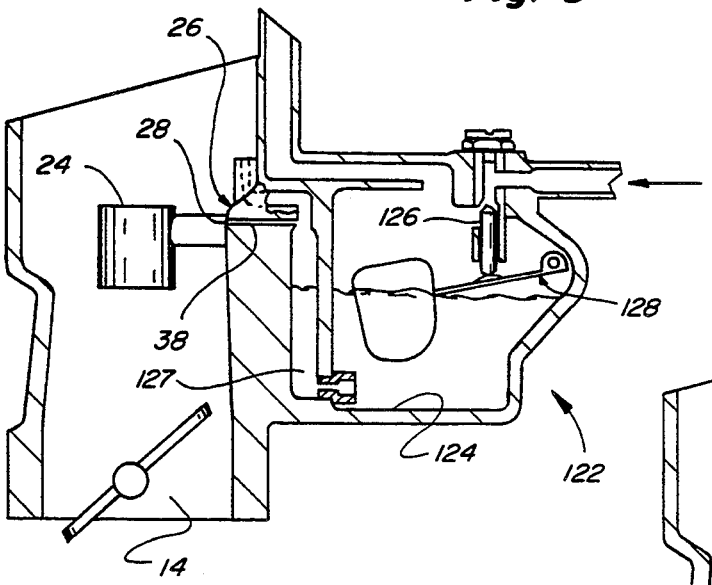
FIG. 9 is a cross-sectional view of a typical prior art float bowl type carburetor modified to include one embodiment of the present invention.

Referring to FIG. 9, a typical prior art float bowl type carburetor construction 122 is shown. The carburetor construction 122 includes a bowl 124 for receiving and holding fuel from a fuel supply; means for metering the inflow of fuel to the bowl including an inlet valve 126 controlled by a float mechanism 128; and means for communicating fuel from the fuel bowl 124 to a venturi passageway 14, including to a fuel chamber 127 and a booster member 24. The carburetor 122 includes an existing surface located in the venturi portion thereof which can serve as the present air flow surface 26 as illustrated. As previously discussed, the passageway 38 can be incorporated into the construction 122 as illustrated to provide the advantages of the present invention. Here again, the orifice 28 is located in the higher velocity region of the surface 26.

Figure 10:
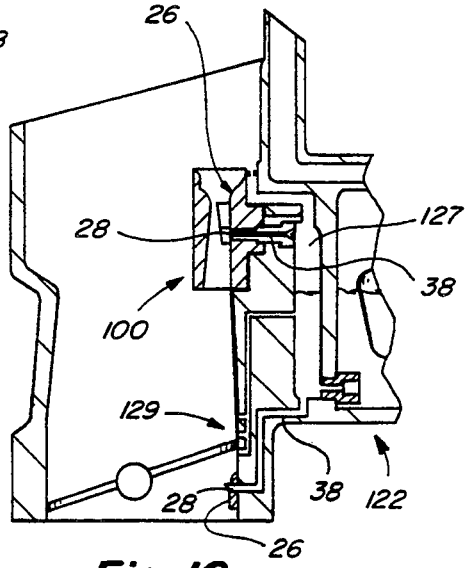
FIG. 10 is a fragmentary cross-sectional view of the prior art float bowl type carburetor of FIG. 9 showing installed thereon the alternative insert member embodiment of the teachings of the present invention.

Referring to FIG. 10, the float bowl type carburetor construction 122 is shown having an insert member 100 constructed according to the teachings of the present invention installed thereon. The installation of the insert member 100 in the float bowl carburetor construction 122 will be substantially similar to that previously described with respect to the carburetor construction illustrated in FIG. 8. In this instance, the conduit 38 is shown in communication with the fuel chamber 127. FIG. 10 also shows an additional air flow surface 26 and orifice 28 in association with the pilot and intermediate fuel circuit 129 of the float bowl carburetor 122. The orifice 28 communicates with the fuel chamber 127 via the conduit 38 as discussed above. This additional circuit acts to enhance the transition of fuel delivery from the primary and intermediate fuel circuit 129 to the main fuel circuit associated with the insert member 100.

Figure 11:
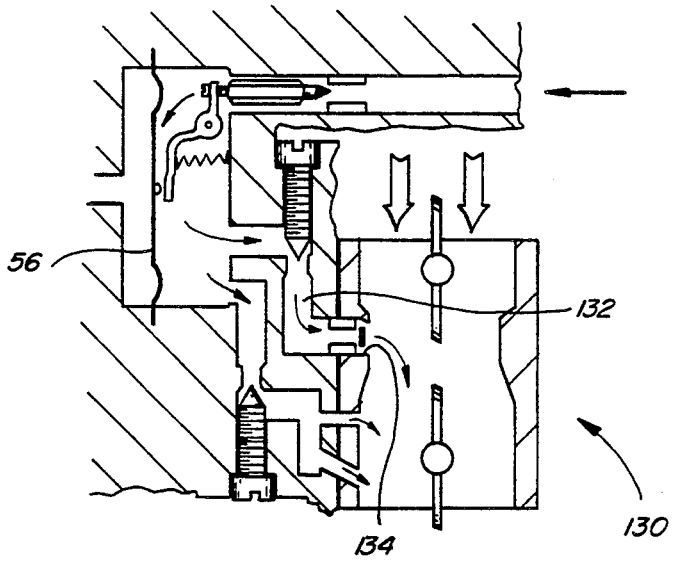
PRIOR ART Fig. 11
FIG. 11 is a cross-sectional view of another prior art diaphragm type carburetor.
Figure 12:
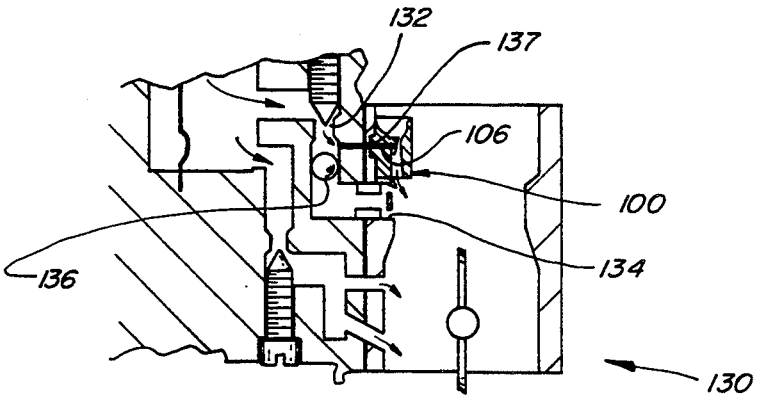
FIG. 12 is a fragmentary cross-sectional view of the carburetor of FIG. 11 showing an insert member constructed according to the teachings of the present invention installed thereon.

FIG. 11 illustrates another diaphragm type prior art carburetor construction 130, which carburetor 130 does not include a booster member 24. The carburetor construction 130 includes a main fuel circuit including a main fuel passageway 132 communicating with a main fuel outlet 134. To install an insert member according to the teachings of the present invention on the carburetor construction 130, the carburetor must be modified so as to receive an insert member, such as the member 100 illustrated in FIG. 7. Referring to FIG. 12, the main fuel passageway 132 can be plugged using any suitable means such as with the soft lead ball 136 shown pressed therein to cut off the main fuel outlet 134. An insert member such as the member 100, can then be mounted on the carburetor as shown using any suitable means, the member 100 being positioned over holes drilled through the carburetor such as the hole 137 communicating the main fuel passageway 132 with the passageway 106 on the insert member 100.

Figure 13:
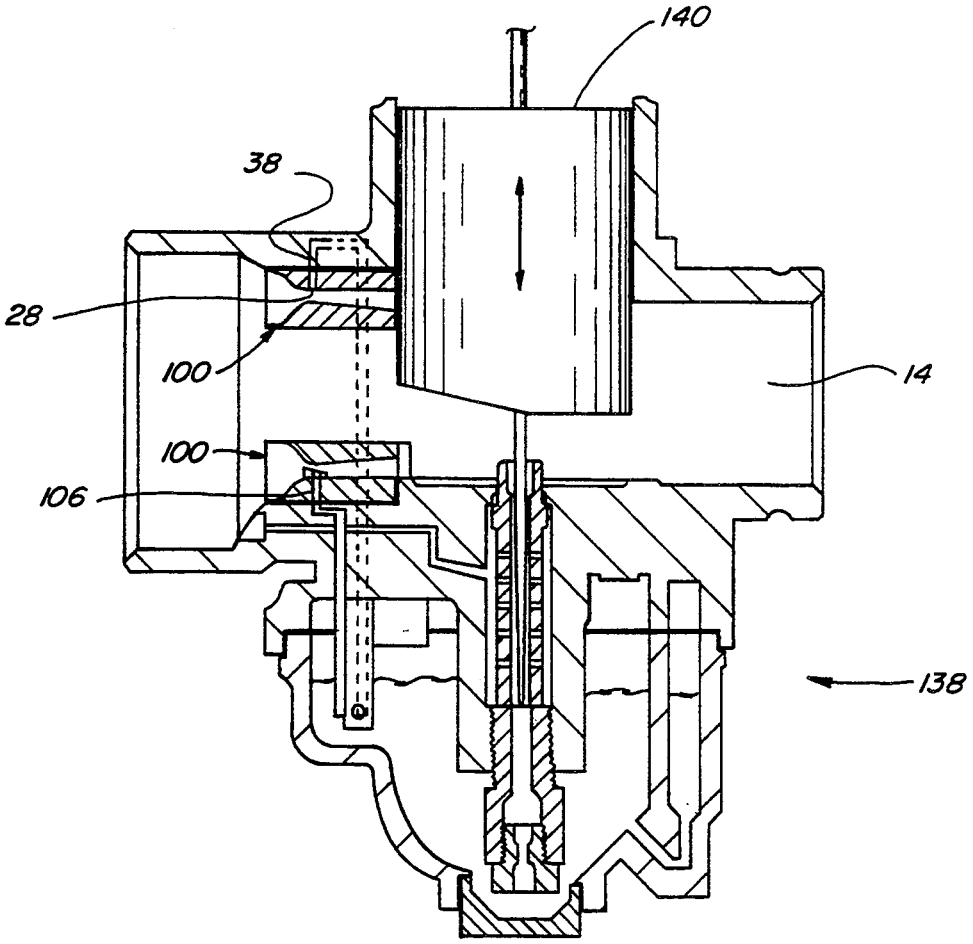
FIG. 13 is a cross-sectional view of a typical prior art slide type carburetor showing insert members constructed according to the teachings of the present invention installed thereon.

Referring to FIG. 13, a pair of insert members 100 are shown installed on a slide type prior art carburetor construction 138. The slide type carburetor 138 includes a cylindrical shaped slide member 140 which is movable transversely across the carburetor passageway 14 to regulate both the flow of air through the passageway 14 and the delivery of fuel thereto. This embodiment shows the use of two insert members 100, one positioned so as to be located in the air stream flowing through the carburetor passageway 14 when the slide member 140 is open any amount, and another member 100 located in diametrically opposed relation to the first insert member so as to be located in the moving air stream only when the slide member 140 is substantially fully open. Here again, appropriate fuel passageways are incorporated into the carburetor 138 to communicate the various passageways 106 and 38 associated with the insert member 100 with the fuel delivery means of the carburetor as previously explained.

Figure 14:
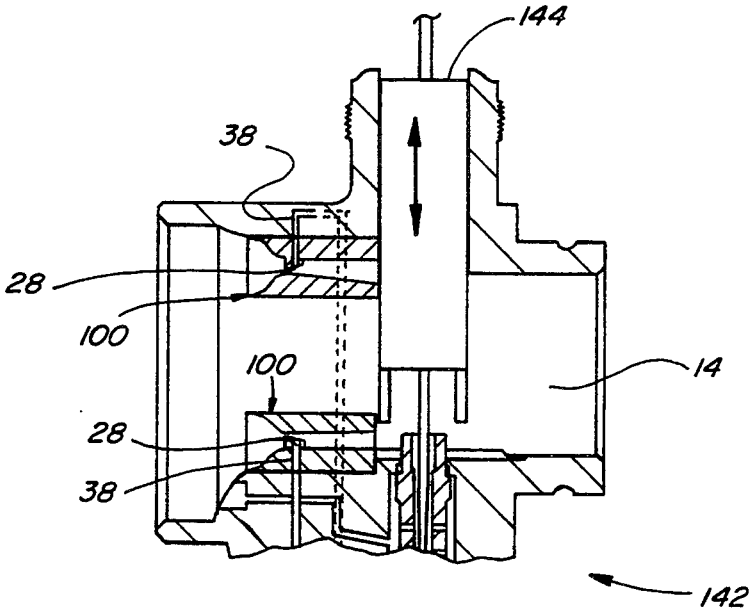
FIG. 14 is a fragmentary cross-sectional view of still another prior art slide type carburetor showing insert members constructed according to the teachings of the present invention installed thereon.

Referring to FIG. 14, still another slide type prior art carburetor construction is shown at 142. This carburetor construction includes a rectangular slide member 144, with two insert members 100 positioned in the passageway 14 in diametrically opposed relation as discussed above. It is important to note that the diametrically opposed positions of the respective insert members 100 in both of these slide type carburetor embodiments are for illustration purposes only, and insert members can be positioned at other locations around a carburetor passageway as desired for a particular application.

Figure 15:
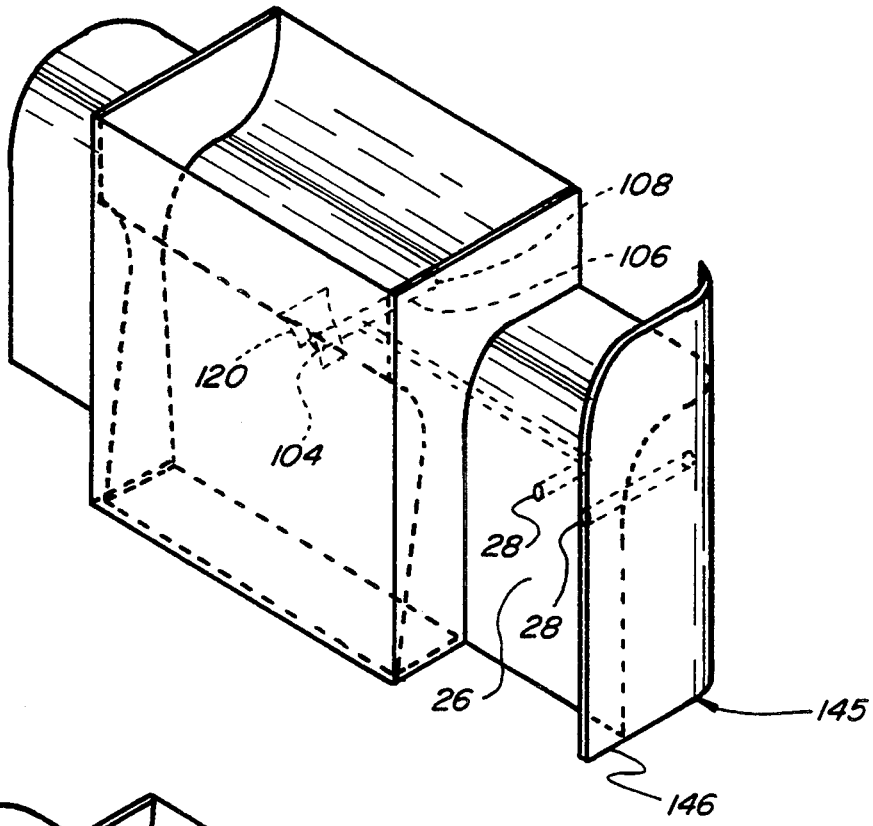
FIG. 15 is a perspective view of an alternative embodiment of the insert member of FIG. 7 showing vortex generator means thereon.
Figure 16:
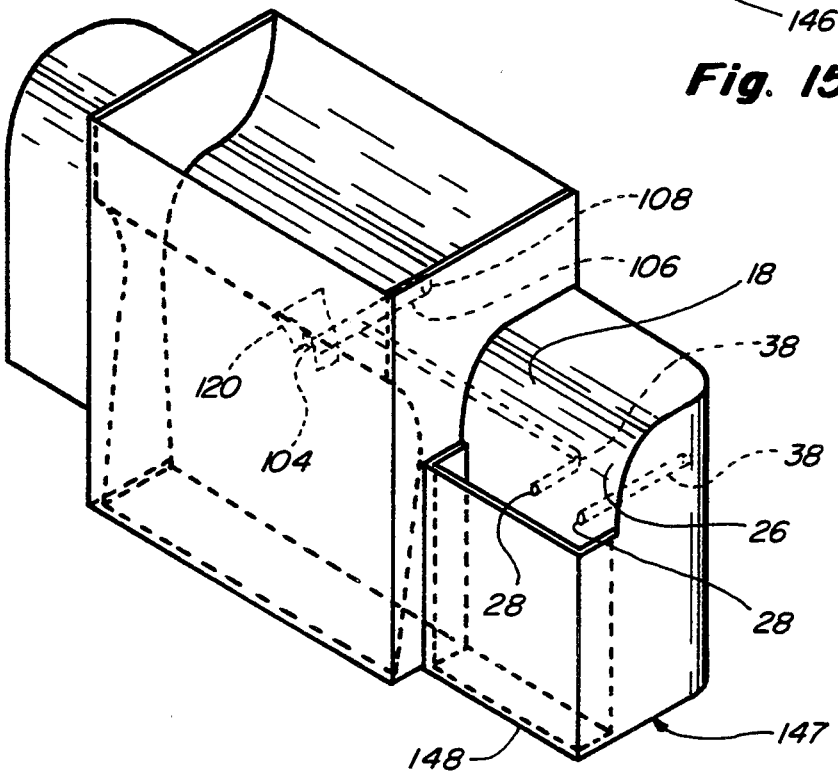
FIG. 16 is another alternative embodiment of the insert member of FIG. 7 showing optional duct means thereon.

Referring to FIGS. 15 and 16, other embodiments 145 and 147 of an insert member can likewise be utilized. For example, insert member 145 (FIG. 15) includes optional vortex generator means 146 adjacent the air flow surface 26, and insert member 147 (FIG. 16) includes optional duct means 148 over a portion of the air flow surface 26 as illustrated. The optional vortex generator means 146 and the duct means 148 provide enhanced air fuel mixing and air flow characteristics over the air flow surface 26, respectively, as well as other beneficial characteristics.

In addition to the above-described benefits and advantages of the present invention, engine tests, and particularly tests of multiple cylinder engines, have shown that engines using carburetors incorporating the present invention run smoother and with less vibration than with carburetors which do not include the present invention. Temperatures in the respective cylinders of multiple cylinder engines have also been found to be more equalized when carburetors incorporating the present invention are used. These superior smoothness, vibration and temperature equalization characteristics are believed to be due to the fuel delivered to the carburetor airstream by the present invention being in more of a vaporized state, which vaporized fuel provides a fuel air mix which facilitates better combustion than emulsified fuel air mixtures and reduces the possibility of premature fuel detonation in engine cylinders. Experiments with carburetors reveal that the present invention enables using main jets having much smaller fuel flow apertures than without the present invention, for instance, even as much as twenty jet sizes smaller. Experiments have also shown that the present invention significantly reduces the criticality of main jet size selection. Still further, disassembly and inspection of engines using carburetors incorporating the present invention reveal remarkably clean combustion chambers which lack significant carbon buildup. Installing and operating a carburetor incorporating the present invention on an engine that has previously been operated using a conventional carburetor has also been found to clean the combustion chamber after only a very short period of operation.

Thus there has been shown and described a novel invention in improved fuel delivery means for internal combustion engine carburetors and methods for installing the same which fulfill all of the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only by the claims which follow.

What is claimed is:

1. A carburetor comprising chamber means for receiving and holding fuel, a side wall forming a passageway for the flow of air therethrough, the air flow passageway including inlet and outlet openings and a constricted portion therebetween, an air flow surface disposed in said passageway adjacent a portion of said side wall intermediate said inlet opening and said constricted portion such that a stream of air flowing through said passageway over the adjacent side wall portion also flows over said air flow surface, the air stream flowing over said air flow surface having a free stream velocity at some location spaced from said air flow surface, said air flow surface providing for air flow velocity over a region thereof greater than said free stream velocity, said air flow surface having a substantially flat cross-sectional shape transverse to the direction of air flow through said passageway, an orifice located in the vicinity of the greater velocity region of said air flow surface, said orifice communicating with said passageway and means for communicating said orifice with said chamber means.

2. The carburetor according to claim 1 wherein said air flow surface has a shape similar to the upper surface of an airfoil.

3. The carburetor according to claim 1 wherein said air flow surface is integrally formed as a portion of said side wall.

4. The carburetor according to claim 1 wherein said air flow surface is located on a member mounted in said air flow passageway.

5. The carburetor according to claim 1 wherein said orifice is located on said air flow surface.

6. The carburetor according to claim 1 wherein said orifice is located on means movable relative to said air flow surface.

7. A carburetor comprising means for receiving and holding fuel, a side wall portion forming a passageway for the flow of air therethrough, the air flow passageway including inlet and outlet openings and a constricted throat portion therebetween, an air flow surface disposed in said passageway on said side wall portion intermediate said inlet opening and said constricted throat portion such that air flowing through said passageway likewise flows over said air flow surface, the air stream flowing over said air flow surface having a free stream velocity at some location spaced therefrom, said air flow surface providing for air flow over at least a portion thereof at a velocity greater than said free stream velocity, said air flow surface having a substantially flat profile transverse to the direction of said air flow thereover, an orifice located in the vicinity of said surface portion in position such that air that flows over said surface flows over said orifice, said orifice communicating with said passageway, and means communicating said orifice with said fuel receiving and holding means, when air flows through said passageway a vacuum condition being produced in said orifice and in said means communicating said orifice with said fuel receiving and holding means, said vacuum condition having an intensity corresponding virtually directly to the air flow velocity over said orifice.

8. In a carburetor having a body member forming at least one chamber for receiving and holding fuel from a fuel source, a venturi for mixing fuel with a stream of air flowing therethrough, means for metering the flow of the fuel into said at least one fuel chamber from said fuel source and means for delivering fuel from said fuel chamber to said venturi, the venturi being defined by a side wall and having an inlet opening, an outlet opening and a constricted portion therebetween, the improvement comprising an air flow surface disposed in said venturi adjacent a portion of said side wall intermediate said inlet opening and said constricted portion such that a stream of air flowing through said venturi over said side wall portion will flow over said air flow surface, the stream of air flowing over said air flow surface having a free stream velocity at a location spaced from said air flow surface, said air flow surface having a substantially flat profile transverse to the direction of air flow thereover and a region over which the air flow velocity is greater than said free stream velocity, an orifice communicating with said venturi located in the vicinity of said surface region, and means communicating said orifice with said at least one fuel chamber, when air flows through said venturi a vacuum condition being produced in said orifice and communicated to said fuel chamber, said vacuum condition having an intensity which varies virtually directly with changes in the air flow velocity over said air flow surface throughout the operating range of the carburetor.

9. The carburetor according to claim 8 wherein said means for metering the flow of fuel into said at least one fuel chamber include diaphragm means.

10. The carburetor according to claim 8 wherein said means for metering the flow of fuel into said at least one fuel chamber include float bowl means.

11. The carburetor according to claim 8 wherein said means for delivering fuel from said at least one fuel chamber to said venturi include booster means.

12. The carburetor according to claim 8 wherein said air flow surface is integrally formed as part of said side wall.

13. The carburetor according to claim 8 wherein said air flow surface is located on an insert member mounted in said venturi.

14. The carburetor according to claim 8 wherein said means for delivering fuel from said at least one fuel chamber to said venturi include a second orifice communicating with said venturi located adjacent to said air flow surface, and means communicating said second orifice with said at least one fuel chamber.

15. The carburetor according to claim 14 wherein said second orifice is located in an air flow duct located adjacent to said air flow surface.

16. The carburetor according to claim 8 further comprising a second orifice communicating with said venturi located in the vicinity of the greater velocity region of said air flow surface, and conduit means communicating said second orifice with said means for delivering fuel from said at least one fuel chamber to said venturi.

17. The carburetor according to claim 8 further comprising vortex generator means located adjacent to said air flow surface.

18. The carburetor according to claim 8 wherein said orifice is located in an air flow duct located adjacent to said air flow surface.

19. A method for installing improved fuel delivery means on a carburetor having a body member forming a venturi for the flow of air therethrough and an open sided cavity located adjacent thereto, the venturi having inlet and outlet portions and a constricted portion therebetween, the cavity being enclosed by a cover member and including a diaphragm member and a metering block mounted therein, said body member having a body portion located between said venturi and said cavity, said body portion including a first surface adjacent said cavity and a second surface opposite said first surface, said second surface being disposed in said venturi such that air flowing through said venturi flows over said second surface, the air flowing over said second surface having a free stream velocity at some location adjacent said second surface, said second surface having a shape which provides for air flow over at least a portion thereof at a velocity greater than said free stream velocity, said method comprising the steps of:

1) removing the cover member, the diaphragm member and the metering block to expose the first surface of said body portion;
2) drilling a hole through said body portion from said first surface to a location on the second surface in the vicinity of said surface portion where the velocity of the air flowing thereover is greater than said free stream velocity, said hole communicating said venturi with said cavity; and
3) reinstalling said metering block, diaphragm member and said cover member.

20. A carburetor comprising means for receiving and holding fuel, a side wall portion forming a passageway for the flow of air therethrough, the air flow passageway including inlet and outlet openings and a constricted portion therebetween, said side wall portion including a surface disposed in said passageway intermediate said inlet opening and said constricted portion such that air flowing through said passageway likewise flows over said surface, the air flowing over said surface having a free stream velocity at some location spaced therefrom, said surface having a shape approximating the shape of an upper wing surface including a substantially flat profile transverse to the direction of air flow thereover, said surface providing for air flow over at least a portion thereof at a velocity greater than said free stream velocity, an orifice located on said surface in the vicinity of said higher velocity surface portion, said air flowing over said surface causing a vacuum signal to be generated in said orifice proportional to the air flow velocity thereover, and means for communicating said vacuum signal to said means for receiving and holding fuel.

21. In a carburetor for an internal combustion engine having means for receiving and holding fuel and a side wall portion forming a passageway for the flow of air therethrough to the engine, the air flow passageway including air inlet means for the inflow of air into the passageway, outlet means for the flow of air from said passageway to the engine, and a constricted throat portion between said inlet means and said outlet means, said carburetor further including means for delivering fuel to said air flow passage from said fuel holding means, and throttle means located in said passageway for regulating the flow of air therethrough including a member positionable at different positions relative to said passageway, air flowing through said passageway having velocity characteristics dependent on factors including the throttle member position and air demand by the engine, the improvement comprising means for providing a vacuum signal from said air flow passageway to some other portion of said carburetor, said vacuum signal having a signal strength which corresponds substantially proportionally to the velocity of air flowing through said passageway, said means for providing a vacuum signal including a surface located on said side wall portion, said surface having a relatively flat profile transverse to the direction of air flow through said air flow passageway and providing a region of lowest air pressure thereover, an orifice located in the vicinity of said region of lowest air pressure, and a passageway communicating said orifice with said other portion of said carburetor.

22. In the carburetor according to claim 21, said other portion of said carburetor including said means for receiving and holding fuel.

23. In the carburetor according to claim 21, said other portion of said carburetor including said fuel delivery means.

24. The carburetor according to claim 21 wherein said means for providing a vacuum signal are located intermediate said air inlet means and said constricted portion.

25. The carburetor according to claim 21 wherein said means for providing a vacuum signal are located intermediate said constricted portion and said outlet means.

* * * * *